United States Patent [19]

Rebel et al.

[11] 4,162,652

[45] Jul. 31, 1979

[54] DEVICE FOR CLEANING CYLINDER BEARERS ON PRINTING PRESSES

[75] Inventors: Herbert Rebel, Rodgau; Claus Simeth, Muhlheim, both of Fed. Rep. of Germany

[73] Assignee: Roland Offsetmaschinenfabrik Faber & Schleicher AG, Fed. Rep. of Germany

[21] Appl. No.: 909,546

[22] Filed: May 25, 1978

[51] Int. Cl.[2] ..... B41F 35/00; B41L 41/00

[52] U.S. Cl. ..... 101/425; 101/216; 184/3 R; 101/DIG. 10

[58] Field of Search ..... 101/425, 423, 424, 212, 101/216, 219, 269, DIG. 10, 349, 157, 169, 416 R, 335, 132.5; 118/70, 264; 15/256.5, 256.51, 236 R; 83/343; 74/230, 467; 100/175, 174; 184/3 R, 3 A, 14, 16, 18, 19, 22

[56] References Cited

U.S. PATENT DOCUMENTS

| | | | |
|---|---|---|---|
| 449,856 | 4/1891 | King | 184/3 R |
| 1,027,559 | 5/1912 | Miner | 184/3 R |
| 1,120,840 | 12/1914 | Niles | 101/425 |
| 3,229,787 | 1/1966 | Henley | 184/19 |
| 3,408,934 | 11/1968 | Clausen | 101/425 |
| 3,785,289 | 1/1974 | Davidson, Jr. | 101/425 X |

FOREIGN PATENT DOCUMENTS

| | | | |
|---|---|---|---|
| 643478 | 6/1962 | Canada | 101/425 |
| 160426 | 3/1933 | Switzerland | 101/425 |

*Primary Examiner*—J. Reed Fisher

*Attorney, Agent, or Firm*—Leydig, Voit, Osann, Mayer & Holt, Ltd.

[57] ABSTRACT

A device for continuously cleaning a bearer in a printing press which includes a carrier in the form of a plate pivoted on the frame for the movement toward and away from the bearer. Mounted on the end portion of the carrier, and oriented in a generally axial direction, is a first scraper in the form of a doctor blade of stiff but wearable material and a second scraper in the form of a relatively soft, lubricated bar of felt, the carrier being biased for simultaneous contact of the scrapers against the bearer surface. The first scraper is oriented at a slight angle with respect to the bearer axis so that the material which is scraped from the bearer tends to be urged sideways for continuous discharge. The second scraper occupies a pocket in the carrier so that it may be rotationally indexed into a new position in the pocket as its presented edge becomes worn. A first stop interposed in the path of movement of the carrier prevents the carrier from scraping against the surface of the bearer as the scrapers are worn away. A second or latching stop is provided for latching the carrier in upraised position against the force of bias to facilitate cleaning the cylinder.

8 Claims, 2 Drawing Figures

DEVICE FOR CLEANING CYLINDER BEARERS ON PRINTING PRESSES

It is common in printing presses to provide the cylinders with bearers in the form of smoothly machined ring-like surfaces at the ends of the cylinders which roll directly against one another to maintain accurate interaxial spacing. One problem in the use of bearers is that particulate impurities tend to adhere and accumulate on the bearer surfaces. Since the bearer-to-bearer system is rigid and relatively inelastic, the existence of even a small, hard particle may be noticeable in the quality of the print. Build-up of an accumulation of impurities may lead, in extreme cases, to bouncing of the cylinders, applying shock loading to the cylinder bearings. In addition, the integrity of the smooth bearer surfaces may be permanently affected, reducing the printing quality of the machine.

It is, accordingly, an object to provide a device for continuously cleaning a bearer in a printing press in which the bearer surface is constantly swept clear of impurities before such impurities can enter the bearer nip.

It is another object to provide a cleaning device for a bearer which is capable of continuously and completely scraping off even tightly adherent deposits.

It is another object of the invention to provide a continuous cleaning device employing a dual scraper in which a first, or doctor, blade formed of stiff but wearable material does the actual scraping and in which the second scraper is in the form of a lubricated bar of felt which serves to finally clean the scraped surface and to provide lubrication for the doctor blade as well as lubricating the interengaging bearer surfaces.

It is a more specific object to provide a device for constantly cleaning a bearer which employs a stiff but wearable doctor blade in which wear is minimized by the lubricating action. In this connection it is an object to provide a cleaning device utilizing a bar of lubricated felt but in which the bar of felt may be rotationally indexed with respect to a receiving pocket, thereby greatly increasing the operating life of the device before replacement becomes necessary.

It is still another object to provide a device of the above type which cannot possibly damage the finely machined bearer surfaces even when the device becomes worn and which, in addition, has provision for latching into an upraised throw-off position at the will of the operator.

It is yet another object to provide a device of the above type which is highly economical and compact and which may be used universally in new designs of presses as well as presses already in the field.

Other objects and advantages of the invention will become apparent upon reading the attached detailed description and upon reference to the drawings in which.

Figure 1:
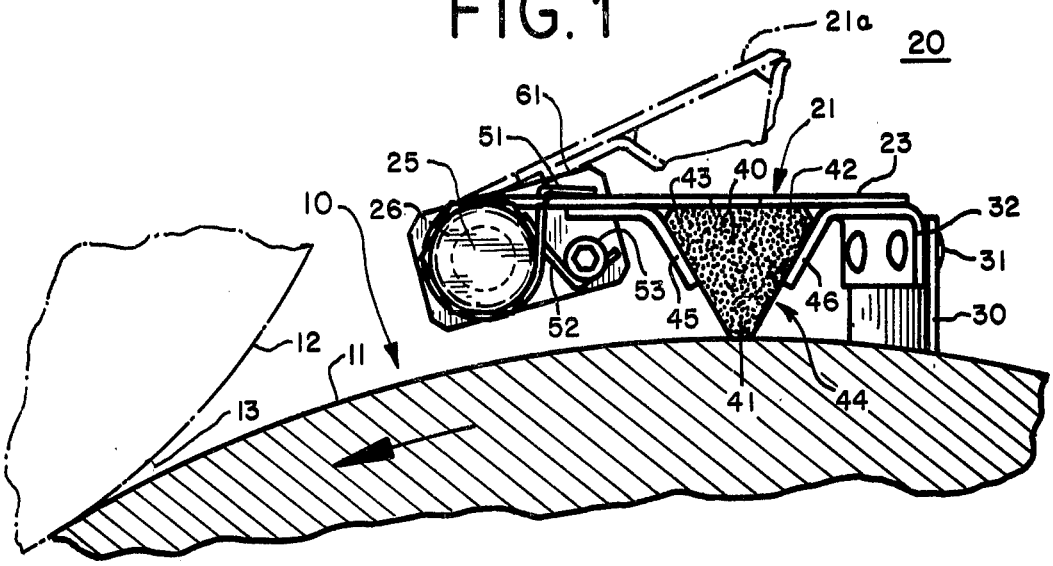
FIG. 1 is an elevational view of a cleaning device constructed in accordance with the present invention mounted in position over a bearer ring.

while the device has been disclosed in connection with a preferred embodiment, it will be understood that the invention is not limited to the particular embodiment shown and that it is intended, on the contrary, to cover the various alternative and equivalent forms of the invention included within the spirit and scope of the appended claims.

Turning now to the drawing there is shown, fragmentarily, a press cylinder 10 having at its end a circular bearer ring 11 which is smoothly finished and which rotates in direct contact with a bearer ring 12 on a cooperating cylinder forming a nip 13. The purpose, as stated, is to maintain constant and precise axis-to-axis dimension between cooperating cylinders as required for high quality printing. The frame of the press, indicated schematically at 15 carries a bracket 16. The cleaning assembly 20 is secured to the bracket in a position to overlie the bearer 11. The cleaning assembly includes a rigid carrier 21, preferably formed of a plate of metal, which is curled at one end to form a pivot 22 and which has a free or outer end portion 23. Telescoped into the pivoted end 22 of the carrier is a pivot bolt 25 surrounded by a sleeve or spacer 26, the threaded tip of the bolt being tightly engaged with a nut 27 which is fixed, as by the welding, to the bracket 16. With the bolt 25 in axially-extending position, the carrier 21 presents a flat face which is substantially parallel to the bearer surface.

In accordance with the present invention first and second scrapers are secured to the free end portion of the carrier; the first, or upstream, scraper is in the form of a doctor blade of stiff but wearable material while the second scraper is in the form of a relatively soft bar of lubricated felt. The first scraper 30 will be seen as a relatively thin strip of a material which is stiff, durable and long wearing, but a material which is nevertheless substantially softer than the steel which forms the surface of the bearer. A number of stiff wear resistant plastics can be employed for this purpose, a polyamide plastic being preferred. The upper edge of the plastic strip is secured by rivets or the like 31 to the bent-over end portion 32 of the carrier. Mounted adjacent the first scraper is a second scraper 40 formed of a relatively soft bar of lubricated felt, preferably triangular in cross section, having a presented edge 41 and alternate edges 42, 43. The second scraper is seated in a pocket 44 of trapezoidal shape formed between metal strips 45, 46 which are angled convergently. The edge 41 projects from the pocket, and when that edge has become worn, the scraper 40 may be rotationally indexed to bring edges 42, 43 successively into working position. An opening 47 in the carrier aligned with the pocket 44, serves as a "well" for application of liquid lubricant so that the felt is substantially saturated with lubricant at all times. The felt is relatively soft and yieldable as compared to the relatively stiff scraper strip 30 which helps to insure that both scrapers will simultaneously engage the bearer surface independently of play at the pivot.

Figure 2:
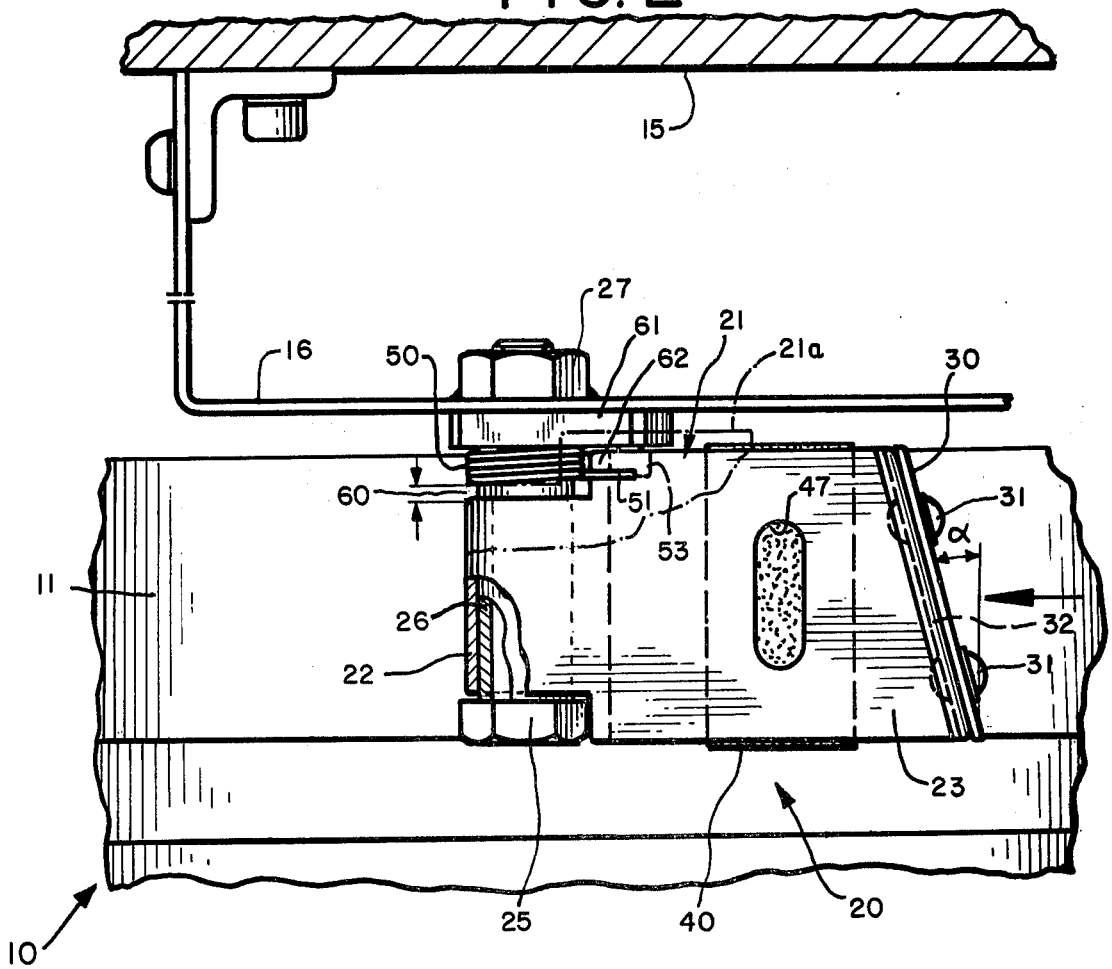
FIG. 2 is a plan view of the device disclosed in FIG. 1.

In carrying out the invention a biasing spring is provided for consistently urging the carrier in the direction of the bearer, with a stop being interposed in the path of movement of the carrier to prevent the metal of the carrier from scraping the surface of the bearer as the scrapers become worn away. The biasing spring, indicated at 50, encircling the pivot bolt, has a first end 51 which bears upon the carrier and a second end 52 which is positioned by a stop 53 in the form of a cap screw which is stationarily mounted with respect to the press frame. As shown in FIG. 2, the head of the cap screw blocks the edge of the carrier (the left-hand edge looking upstream) so that the carrier, regardless of scraper wear, cannot go beyond a point where there is risk of direct scraping of steel against steel.

The scrapers 30, 40 are both arranged in a generally axial direction but it is one of the features of the present invention that the first scraper is oriented at a slight angle with respect to the bearer axis, the angle being indicated at $\alpha$ in FIG. 2. As a result, the material which is scraped from the bearer by the first scraper tends to be urged sideways for continuous discharge beyond the outer edge of the bearer. It is also a feature of the invention that the assembly is located immediately adjacent the nip 13, insuring that a hard particle, such as a particle of abrasive, will be diverted and not pass into the region of high pressure which tends to "cement" or embed a particle depending upon its hardness.

It will be apparent to one skilled in the art that the first relatively stiff and durable scraper 30 and the second soft and lubricated scraper 40 cooperate with one another to perform a result which is much improved over that of either scraper acting alone. Making one scraper stiff and the other soft and yieldable, as stated, insures that there will be simultaneous seating from the outset using only a reasonable spring torque. With the stiff scraper 30 in upstream position, any impurity or deposit, even where tightly adherent, is scraped clean from the bearer surface before the surface reaches the second or lubricated scraper. This protects the lubricated scraper in several ways. In the first place it prevents the full force of bias from being applied directly to the wear-susceptible felt. Second it insures that any adherent deposit on the bearer surface will not, as a result of repeated passage, abrade or wear grooves in the felt. Further, the scraped and accumulated impurities are prevented from reaching the felt and therefore prevent the latter from becoming contaminated. Absent the first scraper blade, the impurities would soon clog the pores of the felt, affecting conduction of lubricant to the bearer surface. Moreover, any particles of an abrasive nature which might become entrained in the felt would not be continuously shed but would continue indefinitely their abrasive action, with aggravated wear of the bearer surface. In short, the first scraper in addition to performing its primary function protects and substantially extends the life of the second.

The reverse is also true: The second scraper 40, by reason of the film of lubricant which it constantly applies to the bearer 11, insures that upon completion of a circuit of rotation a lubricated surface will be constantly engaged by the first scraper which substantially reduces its rate of wear. Moreover, the film of lubricant deposited by the second scraper acts to reduce adherence of impurities, tending to "float" them on the surface of a lubricant film so that they are more readily removed by the blade. The lubricant also tends to keep at least certain kinds of impurities in a more softened state. Thus, the action of the lubricated felt bar is to protect and greatly extend the life of the blade 30.

It is nevertheless true that a certain amount of wear is inevitable at both of the scrapers, with wear tending to take place at a somewhat faster rate at the soft felt scraper. The triangular shape of the felt bar, and the conforming trapezoidal shape of the pocket 44 enables the felt to be indexed forwardly through 120° increments for successive utilization of the edges 41, 42, 43 before replacement of the entire unit becomes necessary.

In accordance with one of the more detailed aspects of the present invention a second, or latching, stop is provided on the frame for latching the carrier 21 in upraised position against the force of bias; in other words, the device includes provision for "throw off" which is useful to prevent the felt from being soaked with solvent when cleaning the cylinder. This is accomplished by providing axial play between the carrier and the bolt on which it is mounted and by providing interengaging stops on the carrier and on the frame which are selectively engageable by moving the carrier along the bolt axis. Thus it will be noted in FIG. 2 that we provide for the relatively small amount of axial play 60 as well as stop surfaces 61 on the frame and 62 on the carrier. To utilize the "throw off" feature, the carrier is manually raised to the position shown dot-dash in FIG. 1. Application of slight axial pressure causes the stop surface 62 to overlie the stop surface 60 so that interference takes place holding the carrier in the dot-dash position. To release the carrier it is pulled axially outwardly, restoring the clearance 60 and thereby disengaging the stops 61, 62 so that the biasing spring is free to resume its biasing function.

The device is simple, economical and compact so it may be employed without limitation on each bearer surface of the press, preferably adjacent the nip. However, because of the "lift off" of impurities from one bearer to the other it is possible to bring about a substantial improvement using only one of the cleaning devices for each interengaging pair of bearers.

As used herein, the term "plate" as applied to the carrier is employed in a structual rather than in a geometric sense. The term "wearable" refers to any material which is softer than the steel of which the bearer is made and which therefore wears sacrificially. The term "felt" is intended to apply to any soft, yet tough and resilient material which is sufficiently porous to act as a good conductor of lubricant film to the engaged bearer surface.

We claim as our invention:

1. A device for continuously cleaning a bearer in a printing press having a frame comprising, in combination, a carrier in the form of a plate of metal pivoted on the frame for movement of its outer end portion toward and away from the bearer, a scraper of wearable material secured to the end portion of the plate and oriented in a generally axial direction with respect to the bearer, a spring interposed between the frame and the carrier for biasing the carrier toward the bearer, and a stop on the frame interposed in the path of biased movement of the carrier to prevent the metal of the carrier from scraping the surface of the bearer when the scraper becomes worn away.

2. A device for continuously cleaning a bearer in a printing press having a frame comprising, in combination, a carrier in the form of a rigid plate pivoted on the frame for movement of its free end portion flatly toward and away from the bearer, first and second scrapers secured to the end portion of the carrier and oriented in a generally axial direction with respect to the bearer, a biasing spring interposed between the frame and the carrier urging the carrier toward the bearer, the first scraper being in the form of a doctor blade of stiff but wearable material while the second scraper is in the form of a relatively soft bar of lubricated felt sufficiently yieldable to insure that both of the scrapers contact the bearer surface simultaneously in spite of minor differences in dimension, the first scraper being located on the upstream side of the second scraper.

3. A device for continuously cleaning a bearer in a printing press having a frame comprising, in combination, a carrier in the form of a rigid plate pivoted on the frame for movement of its free end portion toward and away from the bearer, first and second scrapers secured side by side to the end portion of the plate and oriented in a generally axial direction with respect to the bearer, a spring interposed between the frame and the carrier for urging the carrier toward the bearer, the first scraper being in the form of a doctor blade of stiff but wearable material while the second is in the form of a relatively soft bar of felt, the carrier having a pocket for receiving the bar of felt, the carrier further having an opening communicating with the pocket for application of liquid lubricant to saturate the felt, the doctor blade being in the upstream position for scraping adherent deposits from the bearer surface before the same is acted upon by the relatively softer felt.

4. The combination as claimed in claim 1 or claim 2 or claim 3 in which a latching stop is provided in the frame for latching the carrier in upraised position against the force of bias.

5. The combination as claimed in claim 2 or claim 3 in which the first scraper is oriented at a slight angle with respect to the bearer axis so that the material which is scraped from the bearer tends to be urged axially for continuous discharge beyond the outer edge of the bearer.

6. The combination as claimed in claim 2 in which the second scraper is seated in a pocket formed in the carrier, the scraper and the pocket being of mating section so that the scraper presents an edge extending out of the pocket and so that such scraper may be rotationally indexed into a new position in the pocket when the presented edge of the scraper becomes worn.

7. The combination as claimed in claim 3 in which the second scraper is of triangular section and the pocket being of mating trapezoidal section so that the scraper presents an edge extending out of the pocket and so that such scraper may be rotationally indexed into a new position in the pocket when the presented edge of the scraper becomes worn.

8. A device for continuously cleaning a bearer in a printing press having a frame comprising, in combination, a carrier in the form of a rigid plate, a pivot bolt secured to the frame for pivoting the carrier so that the outer end portion thereof is movable flatly toward and away from the bearer, first and second scrapers mounted on the outer end portion of the carrier for simultaneous engagement with the bearer, a spring interposed between the frame and the carrier for biasing the carrier toward the bearer, the first scraper being in the form of a doctor blade of stiff but wearable material while the second scraper, downstream thereof, is in the form of a relatively soft bar of felt saturated with lubricant, the doctor blade being oriented at a slight angle with respect to the bearer axis so that the material which is scraped from the bearer tends to be urged axially for discharge, the frame having a first stop interposed in the path of biased movement for preventing excess advancement of the carrier as the scrapers are worn away and having a second stop for latching the carrier against the force of bias in a disengaged position, the carrier having a limited amount of axial play with respect to the pivot bolt for selective engagement of the second stop.

* * * * *